US007115008B2

(12) United States Patent
Nash

(10) Patent No.: US 7,115,008 B2
(45) Date of Patent: Oct. 3, 2006

(54) SHIFT CONTROL MECHANISM FOR SMALL WATERCRAFT

(75) Inventor: Chester Colburn Nash, Fayetteville, GA (US)

(73) Assignee: Yamaha Motor Manufacturing Corporation of America, Newnan, GA (US)

( * ) Notice: Subject to any disclaimer, the term of this patent is extended or adjusted under 35 U.S.C. 154(b) by 0 days.

(21) Appl. No.: 10/981,441

(22) Filed: Nov. 4, 2004

(65) Prior Publication Data

US 2006/0094311 A1 May 4, 2006

(51) Int. Cl.
*B60K 41/00* (2006.01)

(52) U.S. Cl. ..... 440/86; 74/471 R
(58) Field of Classification Search ..... 440/84, 440/86, 87; 114/144 R; 74/471 R, 480 B
See application file for complete search history.

(56) References Cited

U.S. PATENT DOCUMENTS

| | | | | |
|---|---|---|---|---|
| 2,785,584 | A * | 3/1957 | Hambleton | 440/87 |
| 2,867,132 | A * | 1/1959 | Schroeder | 440/86 |
| 3,085,447 | A * | 4/1963 | Shay | 114/144 R |
| 5,062,815 | A | 11/1991 | Kobayashi | |

* cited by examiner

*Primary Examiner*—Lars A. Olson
(74) *Attorney, Agent, or Firm*—Keating&Bennett, LLP

(57) ABSTRACT

A shift control mechanism of a small watercraft for selectively shifting between a forward, a neutral and a reverse drive mode includes a first mounting bracket, a second mounting bracket, and a shift control lever having a grip for operating the shift control lever and first and second sides. The shift control lever is disposed between the first and second mounting brackets. The shift control lever is rotatably connected between the first and second mounting brackets via at least two connecting members, the shift control lever is supported on each of the first and second sides thereof by respective ones of the first and second mounting brackets, and at least one of the first and second mounting brackets is mounted on a deck of the small watercraft.

15 Claims, 12 Drawing Sheets

SHIFT CONTROL MECHANISM FOR SMALL WATERCRAFT

BACKGROUND OF THE INVENTION

1. Field of the Invention

The present invention relates to a shift control mechanism for small watercraft. More specifically, the present invention relates to a shift control mechanism including a shift control lever for small watercraft which is securely supported by a pair of mounting brackets and a link member for connecting a bowden wire cable to the shift control lever.

2. Description of the Related Art

Personal watercraft have become very popular in recent years. This type of watercraft carries a rider and possibly one or more passengers. A relatively small hull of the personal watercraft commonly defines a rider's area above an engine compartment. An internal combustion engine frequently powers a jet propulsion unit which propels the watercraft. The engine is disposed within the engine compartment in front of a tunnel formed on the underside of the watercraft hull. The jet propulsion unit is located within the tunnel and is driven by the engine.

This type of watercraft offers a wide variety of uses and in order to improve the usability of the watercraft, a shift control mechanism for the watercraft has been provided such that the watercraft can be operated in either a forward direction or a reverse direction. This is accomplished by providing a reverse bucket that cooperates with the discharge nozzle of the jet propulsion unit so as to create a rearward thrust on the watercraft rather than the normal forward thrust. Of course, some type of operator control must be provided so as to permit shifting of the reverse bucket from its normal forward position to its reverse position.

U.S. Pat. No. 5,062,815 discloses a conventional type of shift control mechanism including a shift control lever 33 which is mounted on a deck portion 13 of the watercraft 11 in proximity to the bridge 18. As seen in FIG. 3 of U.S. Pat. No. 5,062,815, the shift control lever 33 is supported by a mounting bracket on one side of the shift control lever 33 and is rotatably mounted to the mounting bracket by a single mounting shaft or pin. One end of a bowden wire cable 35 is directly attached to the shift control lever 33 and the other end of the bowden wire cable 35 is attached to a reverse thrust bucket 31.

Another conventional type of shift control lever 101, which is similar to the shift control lever 33 of U.S. Pat. No. 5,062,815, is shown in FIG. 14 of the present application. As seen in FIG. 14 herein, the shift control lever 101 is rotatably mounted to a mounting bracket 102 via a pin or mounting shaft 103, and the mounting bracket 102 is mounted to the hull 104 of a personal watercraft.

Since the shift control lever 33 of U.S. Pat. No. 5,062,815 and the shift control lever 101 of FIG. 14 of the present application are supported on only one side thereof by the mounting bracket and are rotatably mounted at only one point by the mounting shaft or pin, the shift control levers 33 and 101 are likely to be deflected in a sideways direction or to be bent in the sideways direction when a force is applied thereto. This causes problems such as inhibiting the shift control lever 33 or 101 from being rotated in the forward and reverse directions, damaging the hull of the watercraft, and preventing proper operation of the shift control 33 or 101.

In addition, since the bowden wire cable 35 is directly connected to the shift control lever 33 of U.S. Pat. No. 5,062,815, via, for example, a set screw, the bowden wire cable 35 is often damaged and must be replaced. When replacement of the bowden wire cable 35 is required, since the bowden wire cable 35 extends through the deck 13, replacement is difficult and time consuming.

SUMMARY OF THE INVENTION

To overcome the problems described above, preferred embodiments of the present invention provide a shift control mechanism having a shift control lever which is more securely mounted to the watercraft such that the shift control lever is prevented from being deflected or bent in a sideways direction, and a link member which provides a more secure attachment of a bowden wire cable to the shift control lever in a simplified manner and with which replacement of the bowden wire cable is facilitated.

According to one preferred embodiment of the present invention, a shift control mechanism includes a first mounting bracket, a second mounting bracket, and a shift control lever having a grip for operating the shift control lever and first and second sides. The shift control lever is disposed between the first and second mounting brackets. The shift control lever is rotatably connected between the first and second mounting brackets via at least two connecting members, the shift control lever is supported on each of the first and second sides thereof by respective ones of the first and second mounting brackets, and at least one of the first and second mounting brackets is mounted on a deck of the small watercraft.

The first mounting bracket is preferably secured to the deck of the small watercraft and the second mounting bracket is preferably smaller than the first mounting bracket.

The shift control lever preferably includes a guide hole and a guide slot, and the at least two connecting members include a first connecting member and a second connecting member. The shift control lever is rotatably connected between the first and second mounting members via the first connecting member and the second connecting member. The first connecting member extends through the second mounting member, the guide hole of the shift control lever and the first mounting member. The second connecting member extends through the second mounting member, the guide slot of the shift control lever and the first mounting member.

The second mounting member preferably includes a round radiused detent boss which is preferably arranged to be higher than a gap between the shift control lever and the first and second mounting members. The shift control lever includes three detent holes located radially around the guide hole, and the detent boss is aligned with the three detent holes such that the detent boss is disposed in one of the three detent holes when the lever is moved so as to be in a one of a forward position, a neutral position and a reverse position.

The second mounting member and the shift control lever are preferably arranged such that the detent boss of the second mounting member maintains a constant side pressure on the control lever so as to prevent looseness in the shift control mechanism.

The second mounting member and the shift control lever are preferably arranged such that when the shift control lever is moved to one of the forward, neutral and reverse positions, the detent boss moves into one of the three detent holes, provides feedback in the form of a "click" confirming that the shift control lever is in the one of the forward, neutral and reverse positions, and maintains a desired position of the shift control lever.

The shift control mechanism according to one of the preferred embodiments of the present invention preferably includes a cover which covers the first and second mounting members and a substantial portion of the shift control lever and which includes a concave portion. The grip of the shift control lever is preferably disposed outside of the cover, and the grip of the shift control lever is preferably disposed in the concave portion of the cover when the shift control lever is located in the forward drive mode such that an upper surface of the grip and an upper surface of the cover define a substantially smooth surface.

The grip preferably includes a bumper arranged such that when the grip is disposed in the concave portion of the cover, the bumper is in contact with the concave portion of the cover.

The shift control mechanism according to another preferred embodiment of the present invention preferably further includes a link member for connecting a bowden wire cable to the shift control lever. The link member includes a bent portion at one end thereof which is releasably connected to a through hole in the shift control lever so as to be freely rotatable.

In the shift control mechanism according to one of the preferred embodiments of the present invention, the shift control lever preferably includes a first arm and a second arm, the grip is disposed at an end of one of the first and second arms and the link member is releasably connected to an end of the other of the first and second arms.

In the shift control mechanism according to one of the preferred embodiments of the present invention, the link member preferably extends into a cable sleeve, which in turn extends through a hole in the deck of the small watercraft, and is connected to the bowden wire cable.

The shift control mechanism according to one of the preferred embodiments of the present invention preferably further includes a bracket cable stopper fixed to the deck of the small watercraft so as to be disposed over the hole in the deck and including a slot therein. The cable sleeve includes a groove disposed in an outer surface thereof. The groove of the cable sleeve is disposed in the slot of the bracket cable stopper and the cable sleeve extends through the hole in the deck, and the link member extends through the cable sleeve, where it is connected to the bowden wire cable.

The shift control mechanism according to one of the preferred embodiments of the present invention preferably further includes cable packing disposed between the bracket cable stopper and the deck to seal and prevent water from entering into the deck.

Other features, elements, characteristics, and advantages of the present invention will become more apparent from the following detailed description of the preferred embodiment of the present invention with reference to the attached drawings.

DETAILED DESCRIPTION OF PREFERRED EMBODIMENTS

Figure 1:
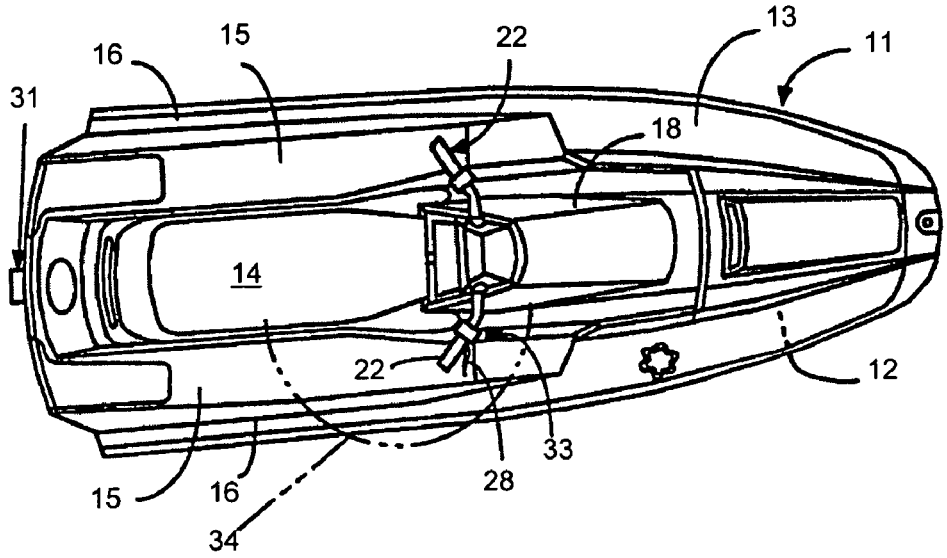
FIG. 1 is a top view of a personal watercraft according to a preferred embodiment of the present invention.

Referring first to FIG. 1, a small watercraft constructed in accordance with a preferred embodiment of the present invention is identified generally by reference numeral 11. The small watercraft 11 is depicted as being of the jet propelled type designed to be operated by a single rider, and possibly one or more passengers, seated in straddle fashion upon the seat of the watercraft 11. It is to be understood, however, that the present invention may be utilized in conjunction with other types of watercraft and watercraft that are designed for multiple riders. The present invention has, however, particular utility in the jet propelled type of watercraft described and shown in FIG. 1.

The watercraft 11 includes a hull having a lower portion 12 and a deck portion 13, each of which may be formed conveniently from a molded fiberglass reinforced plastic as is well known in this art. A seat 14 is provided rearward of the deck 13 and has a pair of recessed foot areas 15 that are disposed on opposite sides thereof and which are located inwardly of raised gunnels 16.

A control bridge 18 is provided forward of the seat 14 on the deck 13 and an internal combustion engine (not shown) is positioned beneath the bridge 18 or the seat 14, within an engine compartment defined by the lower portion 12 and deck portion 13 of the hull. This internal combustion engine drives a jet propulsion unit (not shown) which is positioned within a tunnel formed at the rear of the hull beneath the seat 14. The jet propulsion unit may be of any known type but includes a pivotally supported discharge nozzle (not shown) which is pivotal about a vertically extending axis for steering purposes as is well known in this art.

A handlebar assembly 22 is supported by the bridge 18 forwardly of the seat 14 and is located such that the operator may conveniently steer the watercraft.

Although the engine for the watercraft 11 is not depicted, it includes a throttle control mechanism.

Figure 3:
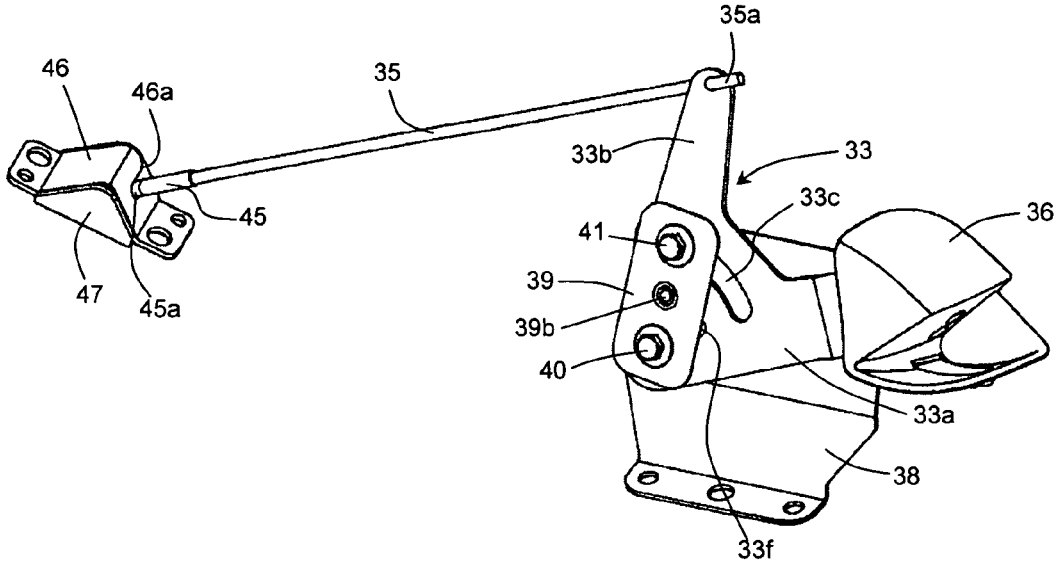
FIG. 3 is a plan view of the shift control mechanism according to a preferred embodiment of the present invention.
Figure 4:
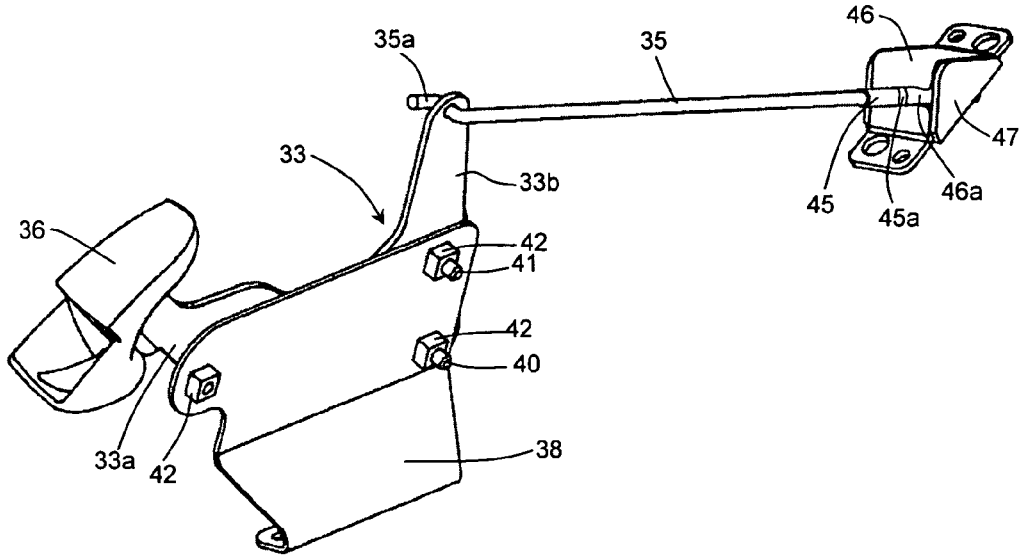
FIG. 4 is another plan view of the shift control mechanism of the shift control system according to a preferred embodiment of the present invention.
Figure 5:
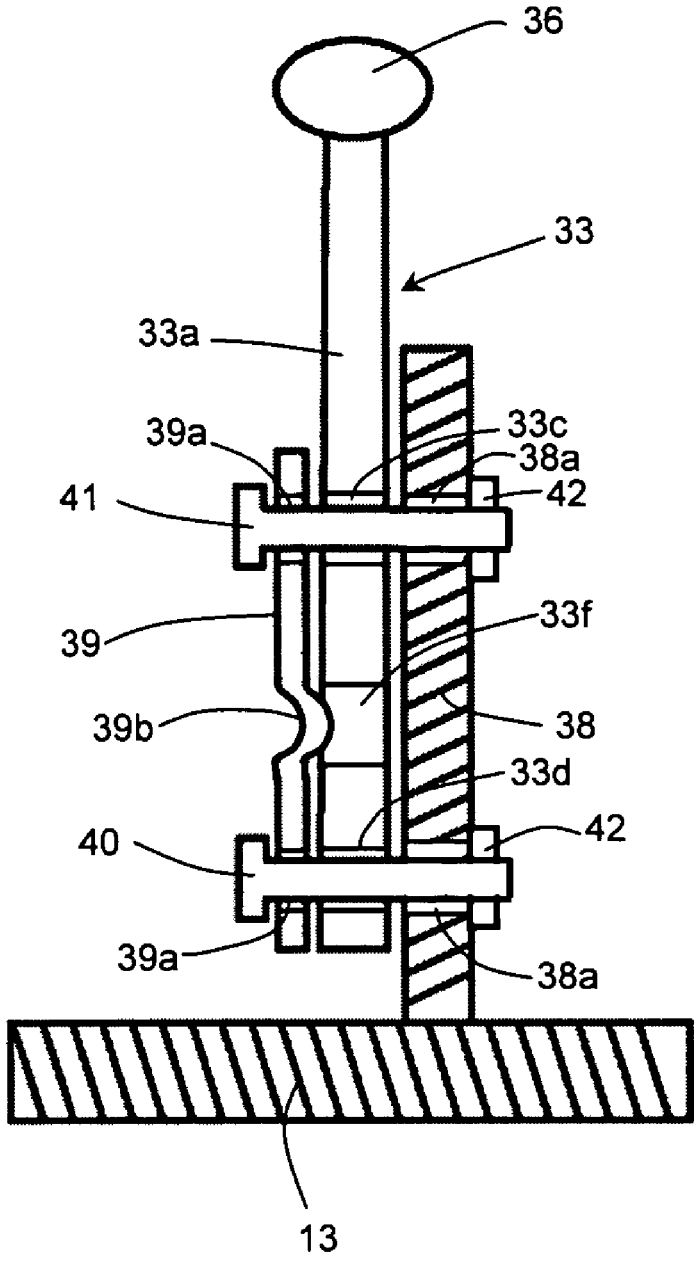
FIG. 5 is a sectional view of the shift control lever and mounting members according to a preferred embodiment of the present invention.
Figure 6:
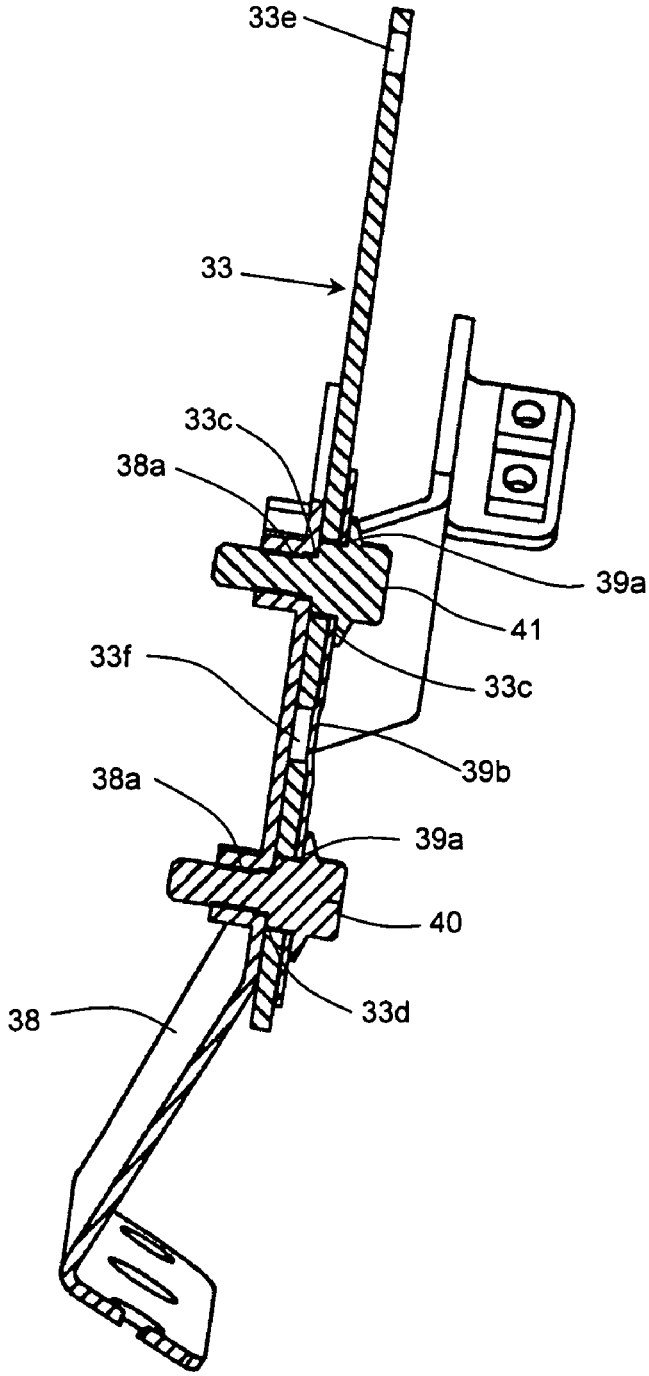
FIG. 6 is another sectional view of the shift control lever and mounting members according to a preferred embodiment of the present invention.
Figure 7:
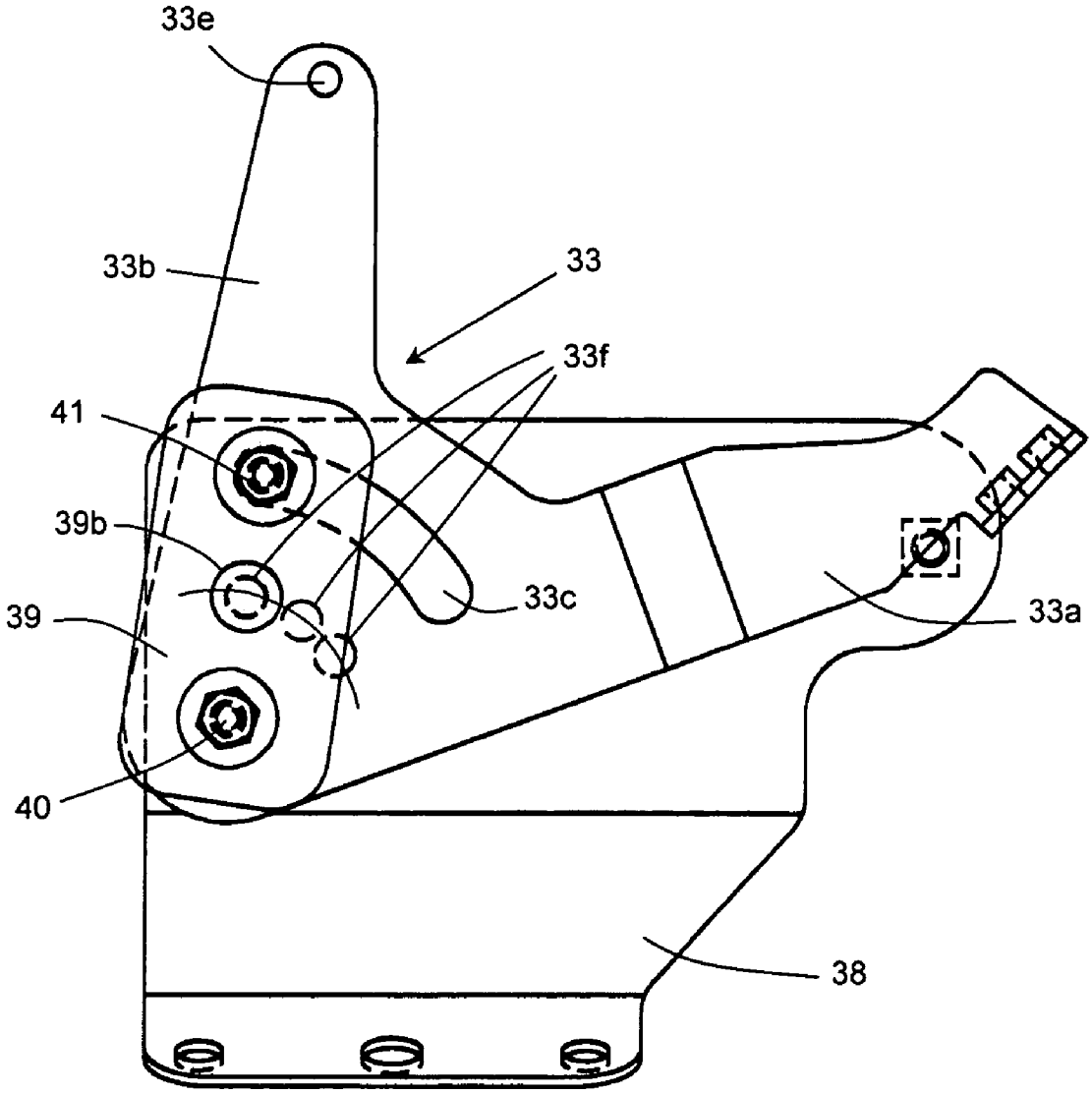
FIG. 7 is a side view of the shift control lever and mounting members according to a preferred embodiment of the present invention.
Figure 8:
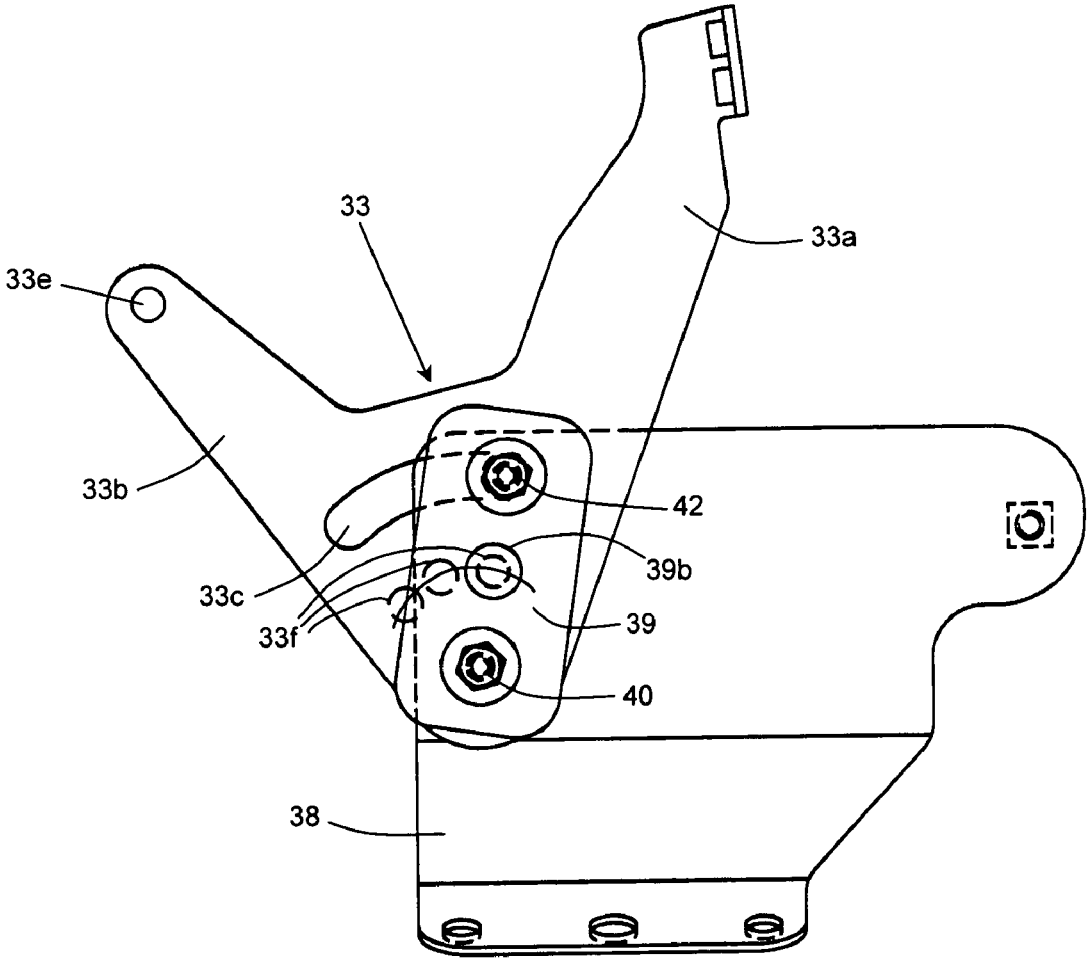
FIG. 8 is another side view of the shift control lever and mounting members according to a preferred embodiment of the present invention.
Figure 9:
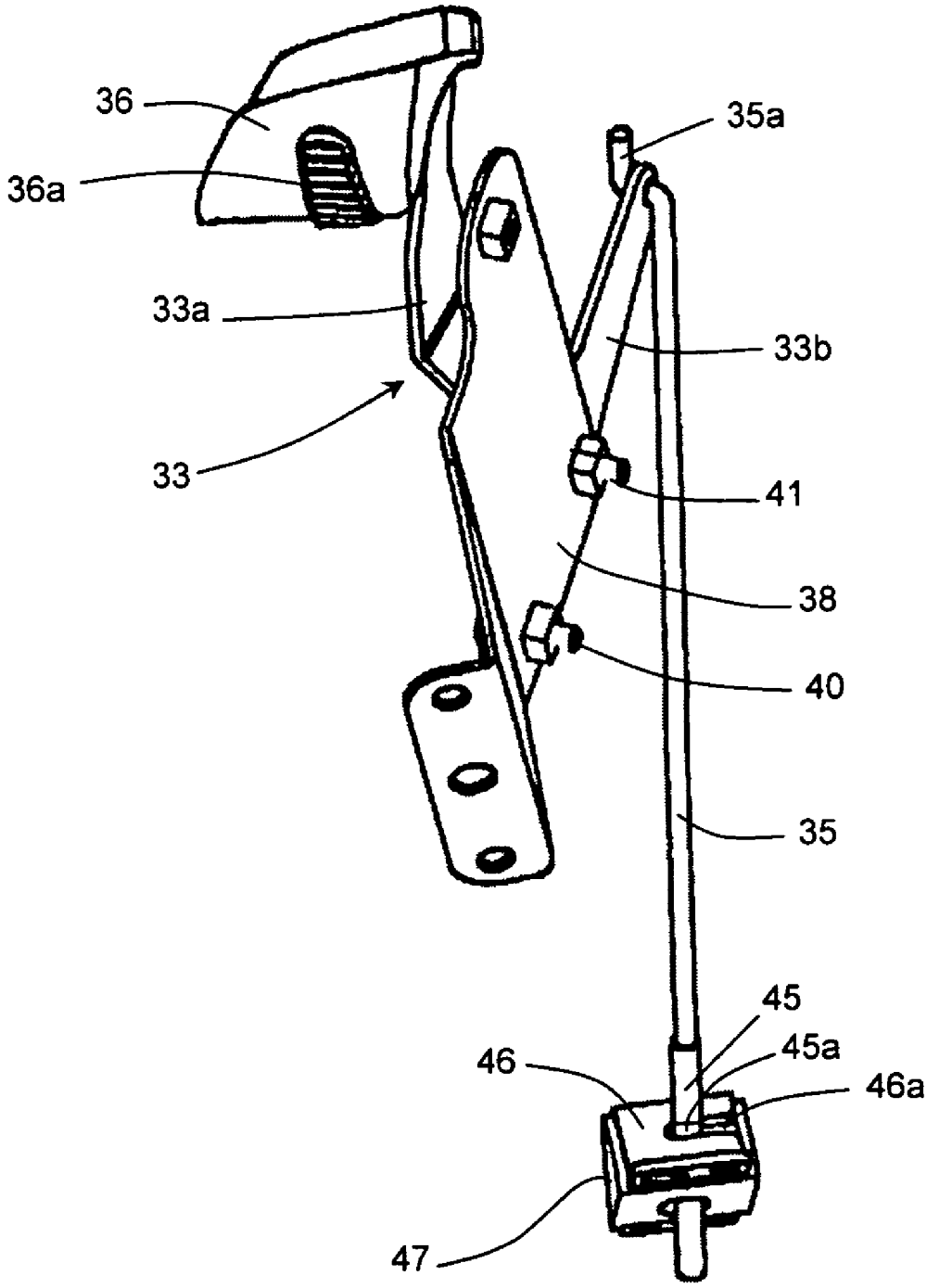
FIG. 9 is another plan view of the shift control system of the shift control mechanism according to a preferred embodiment of the present invention.
Figure 10:
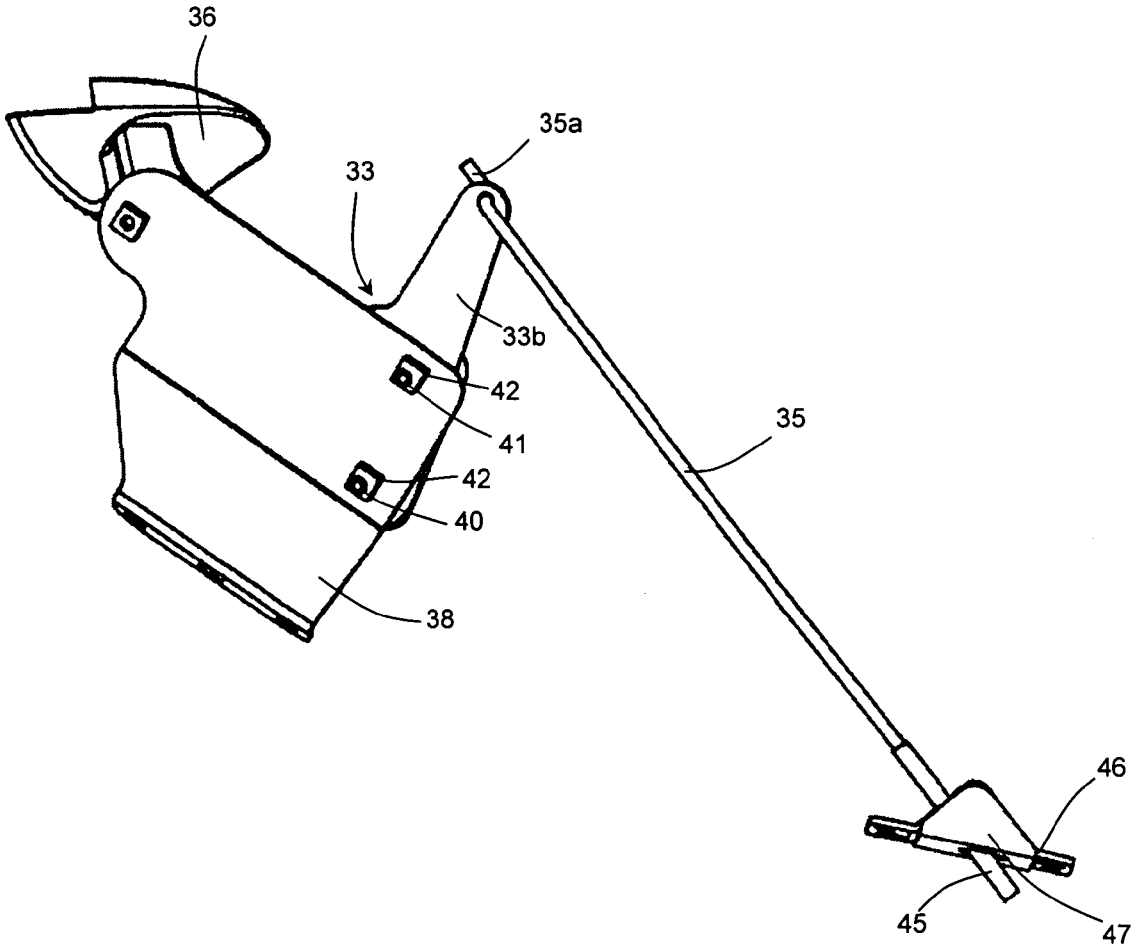
FIG. 10 is another plan view of the shift control system of the shift control mechanism according to a preferred embodiment of the present invention.
Figure 11:
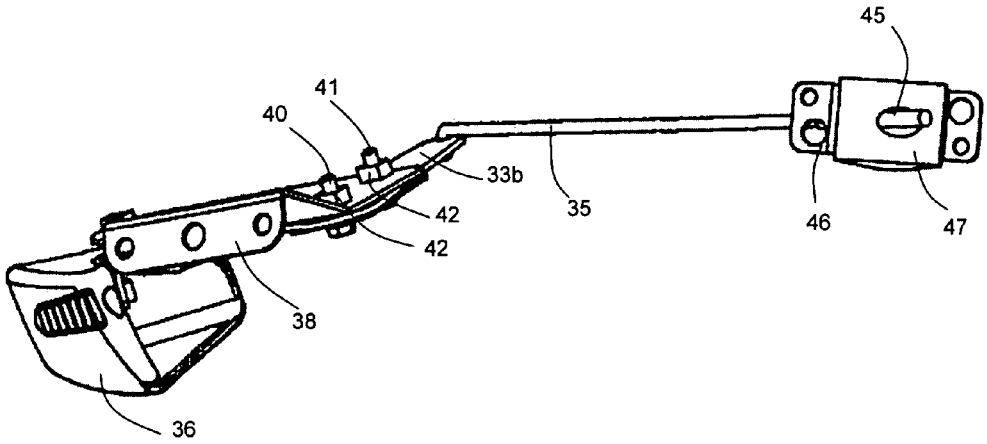
FIG. 11 is still another plan view of the shift control mechanism according to a preferred embodiment of the present invention.

In accordance with a preferred embodiment of the invention, the watercraft 11 is also provided with a shift control mechanism for permitting the watercraft 11 to be operated selectively in a forward, a neutral or a reverse drive mode. To this end, there is provided a reverse thrust bucket, indicated by reference numeral 31 which is pivotally supported on the steering nozzle (not shown) of the jet propulsion unit by a pair of transversely spaced apart pivot pins, in a similar manner to the reverse thrust bucket shown in FIG. 3 of U.S. Pat. No. 5,062,815. The reverse thrust bucket 31 is pivotal from the forward drive position to a neutral drive position to a reverse drive position wherein the jet propulsion unit will power the watercraft 11 in a reverse direction.

A shift control lever 33 is mounted on the hull and specifically on the deck portion 13 in proximity to the bridge 18 in an area encompassed by the phantom line 34 as shown in FIG. 1. The phantom line 34 defines an area in which the operator can reach when the operator is seated in a normal position on the seat 14. However, the location of the shift lever 33 is such that the operator must remove his hand from the throttle lever 28 before he can operate the shift lever 33 with that same hand. This ensures that the speed of the watercraft will be reduced when the operator shifts from either reverse to forward, or from forward to neutral or reverse, or from neutral to either forward or reverse. This provides obvious safety advantages.

Figure 12:
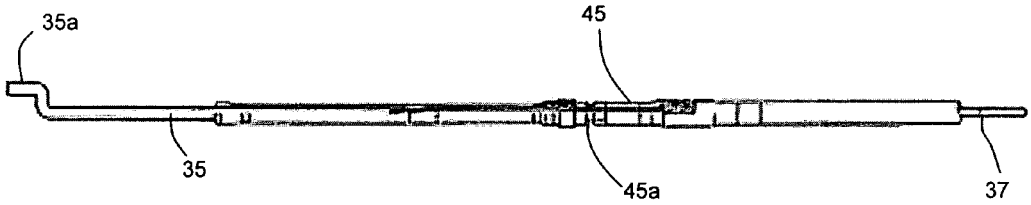
FIG. 12 is a side view of the link member inside the cable sleeve with the bowden wire cable according to a preferred embodiment of the present invention.

A bowden wire cable 37, as seen in FIG. 12, for example, interconnects the shift control lever 33 via a link member 35 with the reverse thrust bucket 31 for pivoting the reverse thrust bucket 31 between its respective described positions upon movement of the shift lever 33 between the forward, neutral and reverse drive modes.

As seen in FIGS. 2–11, the shift control lever 33 preferably has a substantially V-shaped configuration and includes an arm 33*a* having a grip 36 mounted thereon and an arm 33*b* to which the link member 35 is releasably connected. The shift control lever 33 further includes a guide slot 33*c*, a guide hole 33*d* and three detent holes 33*f* disposed therein.

Alternatively, the shift control lever could be configured such that the grip, the guide hole and the link member hole are aligned in a substantially straight line with the guide hole being disposed between the grip and the link member hole. With this alternative configuration, in response to movement of the grip, the link member and the bowden wire cable would be moved in the opposite direction to that shown in FIGS. 2–11.

A first mounting bracket 38 is fixed to the deck 13. The shift control lever 33 is arranged adjacent to the first mounting bracket 38 and a second mounting bracket 39 is disposed adjacent to the shift control lever 33 such that the shift control lever 33 is disposed between the first mounting bracket 38 and the second mounting bracket 39. The first and second mounting members 38 and 39 support both sides of the shift control lever 33.

The first mounting bracket 38 includes through holes 38*a*, and the second mounting bracket 39 includes through holes 39*a* that are aligned with the through holes 38*a* of the first mounting bracket 38.

A connecting member 40 is disposed in one of the through holes 39*a* of the second mounting member 39, the guide hole 33*d* of the shift control lever 33 and one of the through holes 38*a* of the first mounting member 38 so as to rotatably connect the shift control lever 33 to the first and second mounting members 38 and 39.

A second connecting member 41 is disposed in another of the through holes 39*a* of the second mounting member 39, the guide slot 33*c* of the shift control lever 33 and another of the through holes 38*a* of the first mounting member 38. The rotation of the shift control lever 33 is limited by the length of the guide slot 33*c*.

In the present preferred embodiment, the connecting members 40 and 41 are preferably defined by shoulder bolts. However, any suitable connecting member can be used.

In addition, in the preferred embodiment, nuts 42 are preferably integrally formed on a back surface of the first mounting member 38 so as to be aligned with the through holes 38*a*, and the bolts 40 and 41 are threaded into the nuts 42 so as to connect the second mounting member 39, the shift control lever 33 and the first mounting member 38 together. However, the nuts 42 may be separate elements from the first mounting member 38, or the connecting members may be of a type which do not require nuts, such as, rivets.

The second mounting member 39 includes an integral, round, radiused detent boss 39*b*, which is raised higher than a gap between the shift control lever 33, and the first mounting member 38 and the second mounting member 39, as shown in FIGS. 5–8. The detent boss 39*b* is disposed in one of three detent holes 33*f* in the shift control lever 33 when the shift control lever 33 is in one of forward, neutral or reverse positions.

As the shift control lever 33 is moved and the detent boss 39*b* is disposed into one of the three detent holes 33*f* in the shift control lever 33, the operator experiences a "click" as the shift control lever 33 enters the forward, neutral or reverse positions. The detent boss 39*b* being disposed in the detent holes 33*f* maintains the bowden wire cable 37, and therefore the reverse bucket 31, in the desired position.

The detent boss 39*b* also causes the second mounting member 39 (which is preferably made of a strong flexible material, such as steel or reinforced plastic) to become a spring that applies pressure to the side of the shift control lever 33 at all times. This side pressure is applied when the detent boss 39*b* is disposed in one of the three detent holes 33*f* or between the three detent holes 33*f*. The side pressure prevents the shift control lever 33 from feeling loose and prevents rattling of the shift lever at any position.

Figure 2:
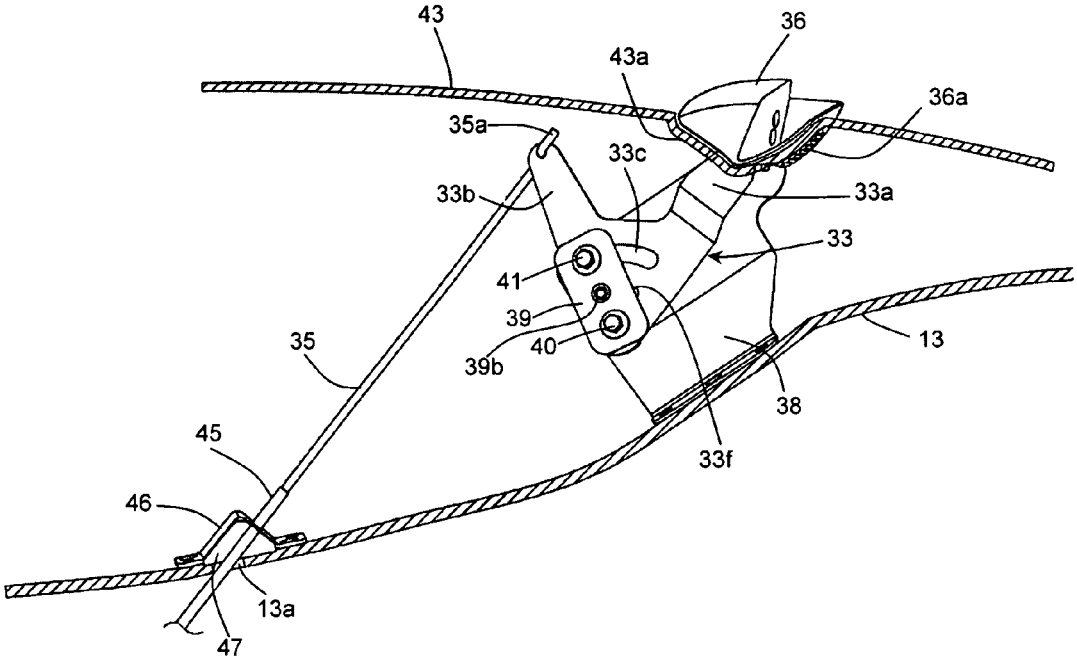
FIG. 2 is a partial side view of a portion of a personal watercraft at which the shift control lever and link member according to a preferred embodiment of the present invention are provided.

A cover 43 is arranged so as to cover the majority of the shift control mechanism, except for the grip 36. The cover includes a concave portion 43*a* located such that when the shift control lever 33 is in the forward drive mode the grip is disposed in the concave portion 43*a* so that the upper surface of the grip 36 and the cover 43 define a substantially smooth surface. This arrangement of the grip 36 and the cover 43 is shown in FIG. 2.

The grip 36 includes a grip bumper 36*a* which contacts the concave portion 43*a* of the cover 43 when the grip 36 is disposed in the concave portion 43*a*. The grip bumper 36*a* is preferably made of rubber or other suitable resilient materials so as to prevent the grip 36 and the cover 43 from vibrating against each other when the grip 36 is disposed in the concave portion 43*a* of the cover 43.

The link member 35 includes a bent portion 35*a* at one end thereof which engages with the through hole 33*e* of the shift control lever 33 so as to be releasably connected to the shift control lever 33.

Figure 13:
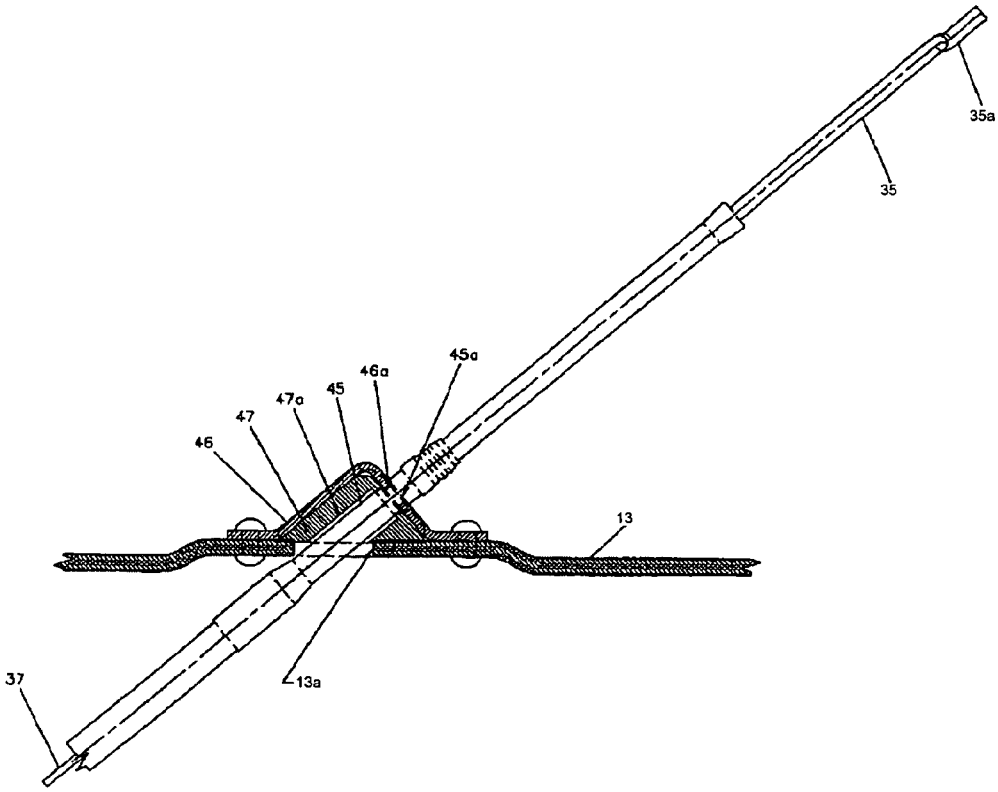
FIG. 13 is a sectional view of the coupling of the cable sleeve to the deck according to a preferred embodiment of the present invention.
Figure 14:
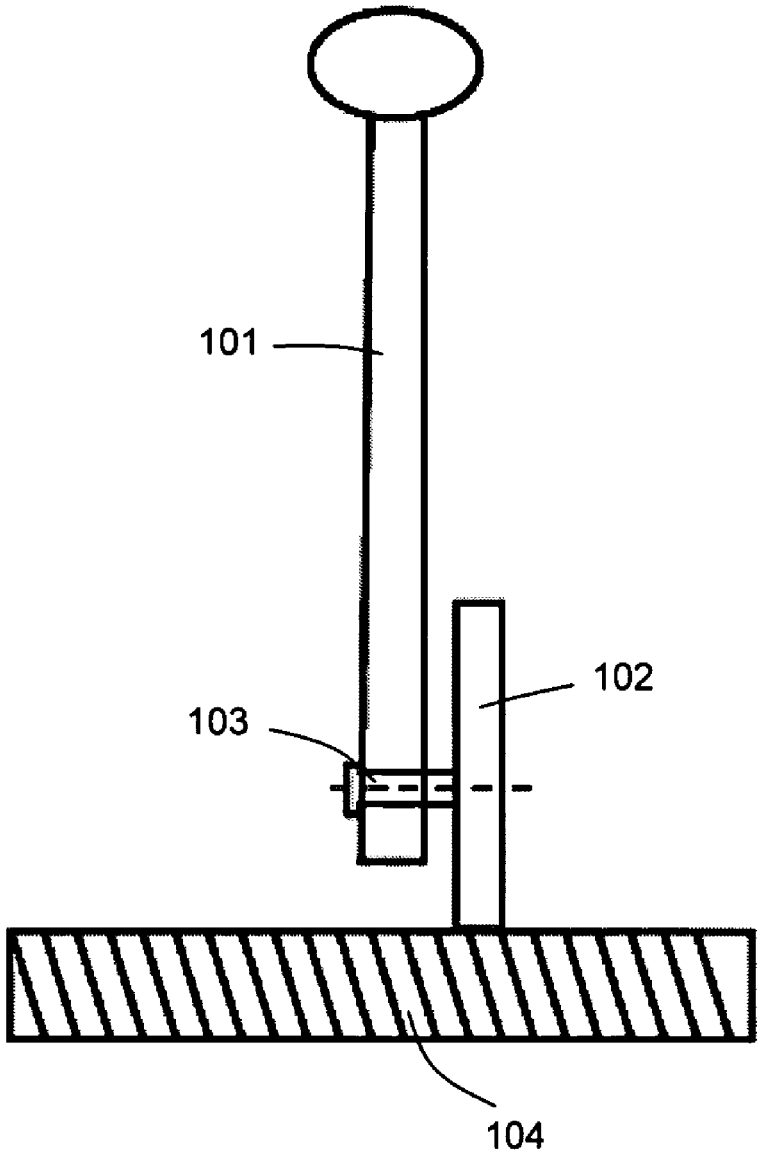
FIG.14 PRIOR ART
FIG. 14 is a sectional view of a shift control lever and mounting structure according to the related art.

The other end of the link member 35 is connected to the bowden wire cable 37 inside a cable sleeve 45, as shown in FIGS. 12 and 13. The cable sleeve 45 includes a groove 45*a* that fits into a slot 46*a* in a bracket cable stopper 46. Cable packing 47 is provided with a hole 47*a* which enables the cable packing 47 to slide over the cable sleeve 45. The bracket cable stopper 46 holds the cable packing 47 in place, and attaches both of the cable sleeve 45 and the cable packing 47 to the deck 13, by, for example, one or more connection members, such as bolts. The hole 47*a* through the cable packing 47 seals itself to the cable sleeve 45, and the bottom of the cable packing 47 seals to the deck 13, around the hole 13*a* so as to prevent water from entering inside the deck 13 and hull 12.

In the present preferred embodiment, the cable packing 47 is made of rubber. However, the cable packing 47 may be made of any suitable sealing material.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A shift control mechanism of a watercraft for selectively shifting between a forward, a neutral and a reverse drive mode comprising:

a first mounting member;

a second mounting member; and a shift control lever having first and second sides and being disposed between the first and second mounting members; wherein the shift control lever is rotatably connected between the first and second mounting members via at least two connecting members extending through the first and second mounting members;

the shift control lever is supported on each of the first and second sides thereof by respective ones of the first and second mounting members; and at least one of the first and second mounting members is mounted on a deck of the watercraft.

2. The shift control mechanism according to claim 1, wherein the shift control lever includes a grip disposed thereon.

3. The shift control mechanism according to claim 1, wherein the first mounting member is secured to the deck of the watercraft and the second mounting member is smaller than the first mounting member.

4. The shift control mechanism according to claim 1, wherein the shift control lever includes a guide hole and a guide slot;

the at least two connecting members includes a first connecting member and a second connecting member;

the shift control lever is rotatably connected between the first and second mounting members via the first connecting member and the second connecting member;

the first connecting member also extends through the guide hole of the shift control lever; and the second connecting member also extends through the guide slot of said shift control lever so as to limit a rotation amount of the shift control lever.

5. The shift control mechanism according to claim 4, wherein the second mounting member includes a round radiused detent boss;

the shift control lever includes a plurality of detent holes located radially around the guide hole; and the detent boss is disposed in one of the detent holes when the shift control lever is moved to a respective one of a forward position, a neutral position and reverse position.

6. The shift control mechanism according to claim 5, wherein the second mounting member and the shift control lever are arranged such that the detent boss of the second mounting member maintains a constant side pressure on the shift control lever so as to prevent looseness in the shift control mechanism.

7. The shift control mechanism according to claim 5, wherein the second mounting member and the shift control lever are arranged such that when the shift control lever is moved to one of the forward, neutral and reverse positions, the detent boss moves into one of the three detent holes, provides feedback that the lever is in the one of the forward, neutral and reverse positions, and maintains a desired position of the shift control lever.

8. The shift control mechanism according to claim 2, further comprising:

a cover which covers the first and second mounting members and a substantial portion of the shift control lever and which includes a concave portion; wherein the grip of the shift control lever is disposed outside of the cover; and the grip is disposed in the concave portion of the cover when the shift control lever is located in the forward drive mode such that an upper surface of the grip and an upper surface of the cover define a substantially smooth surface.

9. The shift control mechanism according to claim 8, wherein the grip includes a bumper arranged such that when the grip is disposed in the concave portion of the cover, the bumper is in contact with the concave portion of the cover.

10. The shift control mechanism according to claim 1, further comprising:

a link member for connecting a bowden wire cable to the shift control lever; wherein the link member includes a bent portion at one end thereof which is releasably connected to a through hole in the shift control lever so as to be freely rotatable.

11. The shift control mechanism according to claim 10, wherein the shift control lever includes a first arm and a second arm, a grip disposed at an end of one of the first and second arms and the link member is releasably connected to an end of the other of the first and second arms.

12. The shift control mechanism according to claim 10, wherein the link member extends into a cable sleeve and the cable sleeve extends through a hole in the deck of the watercraft, and is connected to the bowden wire cable.

13. The shift control mechanism according to claim 12, further comprising:

a cable sleeve;

a bracket cable stopper fixed to the deck of the watercraft so as to be disposed over the hole in the deck and including a slot therein; wherein the cable sleeve includes a groove disposed in an outer surface thereof;

the groove in the cable sleeve is disposed in the slot of the bracket cable stopper and the cable sleeve extends through the hole in the deck; and said link member extends through the cable sleeve where the link member is connected to the bowden wire cable.

14. The shift control mechanism according to claim 13, further comprising cable packing disposed between the bracket cable stopper and the deck to seal and prevent water from entering into the deck.

15. The shift control mechanism according to claim 5, wherein, when the detent boss is disposed in one of the three detent holes, the detent boss helps a bowden wire, attached to the shift control lever, and a reverse bucket, attached to the bowden wire, stay in the respective one of a forward position, a neutral position and a reverse position.

* * * * *